US005921295A

United States Patent [19]

Zelazny et al.

[11] Patent Number: 5,921,295

[45] Date of Patent: Jul. 13, 1999

[54] HIGH SPEED NOZZLE FOR TONER FILLING SYSTEMS

[75] Inventors: Joseph S. Zelazny, Webster, N.Y.; Fumii Higuchi; Joseph C. Barbisan, both of Mississauga, Canada; Paul M. Wegman, Pittsford, N.Y.

[73] Assignee: Xerox Corporation, Stamford, Conn.

[21] Appl. No.: 08/923,016

[22] Filed: Sep. 3, 1997

[51] Int. Cl.[6] ..... B65B 1/04

[52] U.S. Cl. ..... 141/286; 141/256; 222/413

[58] Field of Search ..... 239/591, 592, 239/602; 141/59, 65, 256, 392, 87, 286; 222/411, 412, 413

[56] References Cited

U.S. PATENT DOCUMENTS

| | | | |
|---|---|---|---|
| 1,525,469 | 2/1925 | Sparks | 222/413 |
| 2,114,104 | 4/1938 | Driscoll et al. | 141/256 |
| 2,791,355 | 5/1957 | Morgan | 222/411 |
| 3,248,019 | 4/1966 | Kohler | 222/413 |
| 3,269,611 | 8/1966 | Komarek | 222/413 |
| 3,664,385 | 5/1972 | Carter | 141/12 |
| 4,047,546 | 9/1977 | Bassendale et al. | 141/1 |
| 4,561,759 | 12/1985 | Knott | 355/3 DD |
| 4,650,312 | 3/1987 | Vineski | 355/15 |
| 4,796,747 | 1/1989 | Kajiwara | 198/535 |
| 4,825,913 | 5/1989 | Stott | 141/59 |
| 4,932,355 | 6/1990 | Neufeld | 118/652 |
| 4,977,428 | 12/1990 | Sakakura et al. | 355/245 |
| 5,095,338 | 3/1992 | Hayes, Jr. et al. | 355/246 |
| 5,327,947 | 7/1994 | McGregor | 141/71 |
| 5,337,794 | 8/1994 | Nishiyama et al. | 141/144 |
| 5,438,396 | 8/1995 | Mawdesley | 355/260 |
| 5,531,253 | 7/1996 | Nishiyama et al. | 141/90 |

*Primary Examiner*—David J. Walczak
*Attorney, Agent, or Firm*—John S. Wagley

[57] ABSTRACT

An apparatus for assisting in filling a container from a hopper containing a supply of powder is provided. The apparatus includes a conduit operably connected to the hopper and extending downwardly therefrom. The conduit is adapted to permit a flow of powder therewithin. The apparatus also includes a nozzle operably connected to the conduit and extending downwardly therefrom. The nozzle defines an inlet thereof for receiving powder from the conduit and defines an outlet thereof for dispensing powder from the nozzle to the container. The inlet defines an inlet cross sectional area perpendicular to the flow the powder and an outlet defining an outlet cross sectional area perpendicular to the flow the powder. The inlet cross sectional area is larger than the outlet cross sectional area. The apparatus further includes an conveyor located at least partially within the conduit. The conveyor assists in providing the flow of powder from the container. The dimensions of the nozzle are selected so as to provide a ratio of the inlet cross sectional area to the outlet cross sectional area such that the flow of powder does not seize as it progresses through the nozzle.

10 Claims, 11 Drawing Sheets

HIGH SPEED NOZZLE FOR TONER FILLING SYSTEMS

This invention relates generally to filling a container with material, and more particularly concerns a fill nozzle for controlling the flow of powders such as toner from a fill tube to a toner container.

Currently when filling powders, for example toners into toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner friction. High auger speed will cause the toner to melt, particularly for low melt toner such as disclosed in U.S. Pat. No. 5,227,460 to Mahabadi et al. the relevant portions thereof incorporated herein by reference.

To provide for productive efficient toner containers, typically, the rotating augers used to transport the toner from hoppers are relatively large. The large augers provide for high volume toner flow and thus improve productivity in a fill line. When utilizing such fill lines for small, low cost copiers and printers, difficulties occur in that the openings in the toner containers utilizing such small copiers and printers include a small toner fill opening that may have an irregular shape and have a fill opening that is not centrally located in the container. Problems are thus associated with fitting the large filling tubes and augers with the small toner fill openings.

Problems with filling containers with toner are exacerbated in that the small low cost copies are produced in higher quantities necessitating very efficient toner filling operations.

Problems with efficient toner filling are also apparent in small and medium cost multi-colored highlight or full color printers and copiers. The toner containers for color toner typically are smaller than those for black toner and also more typically have an irregular shape. Further, color toners have been developed with smaller particle size of for example 7 microns or less. These smaller toners are more difficult to flow through toner hoppers and are more difficult to be translated along augers.

Toner containers for small low cost printers and copiers typically have a small opening into which the toner is to be added. Furthermore, the toner containers often have irregular shapes to conform to the allotted space within the copying machine. Therefore it becomes difficult to fill the toner container because of the small tube required to fit into the small toner container opening and secondly for all the toner within the container to completely fill the remote portions of the container before the container overflows.

The problems associated with controlling the filling of toner containers are due primarily to the properties of the toner. Toner is the image-forming material in a developer which when deposited by the field of an electrostatic charge becomes the visible record. There are two different types of developing systems known as one-component and two-component systems.

In one-component developing systems, the developer material is toner made of particles of magnetic material, usually iron, embedded in a black plastic resin. The iron enables the toner to be magnetically charged. In two-component systems, the developer material is comprised of toner which consists of small polymer or resin particles and a color agent, and carrier which consists of roughly spherical particles or beads usually made of steel. An electrostatic charge between the toner and the carrier bead causes the toner to cling to the carrier in the development process. Control of the flow of these small, abrasive and easily charged particles is very difficult.

The one-component and two-component systems utilize toner that is very difficult to flow. This is particularly true of the toner used in two component systems, but also for toner for single component systems. The toner tends to cake and bridge within the hopper. This limits the flow of toner through the small tubes which are required for addition of the toner through the opening of the toner container. Also, this tendency to cake and bridge may cause air gaps to form in the container resulting in partial filling of the container.

Attempts to improve the flow of toner have also included the use of an external vibrating device to loosen the toner within the hopper. These vibrators are energy intensive, costly and not entirely effective and consistent. Furthermore, they tend to cause the toner to cloud causing dirt to accumulate around the filling operation.

Also, difficulties have occurred in quickly starting and stopping the flow of toner from the hopper when filling the container with toner in a high speed production filling operation. An electromagnetic toner valve has been developed as described in U.S. patent applications Ser. Nos. 08/540,993 and 08/690,412, assigned to the same assignee as this application, the relevant portions incorporated herein by reference. The electromagnetic valve is limited for use with magnetizable toner such as that described for use with one component development systems.

Attempts have been made to fill toner containers having small toner fill openings by utilizing adapters positioned on the end of the toner filling auger which has an inlet corresponding to the size of the auger and an outlet corresponding to the opening in the toner container. Clogging of the toner, particularly when attempting to increase toner flow rates and when utilizing toners with smaller particle size, for example, color toners having a particle size of 7 microns or less, has been found to be a perplexing problem. The adapters that are fitted to the augers, thus, tend to clog with toner. The flow rates through such adapters is unacceptably low.

Further, the use of these adapters may create problems with maintaining a clean atmosphere free of toner dust at the filling operation.

The following disclosures may be relevant to various aspects of the present invention:

U.S. Pat. No. 5,337,794

Patentee: Nishiyama et al.

Issue Date: Aug. 16, 1994

U.S. Pat. No. 5,438,396

Patentee: Mawdesley

Issue Date: Aug. 1, 1995

U.S. Pat. No. 5,095,338

Patentee: Hayes, Jr. et al.

Issue Date: Mar. 10, 1992

U.S. Pat. No. 4,977,428

Patentee: Sakakura et al.

Issue Date: Dec. 11, 1990

U.S. Pat. No. 4,932,355

Patentee: Neufeld

Issue Date: Jun. 12, 1990

U.S. Pat. No. 4,650,312

Patentee: Vineski

Issue Date: Mar. 17, 1987

U.S. Pat. No. 4,561,759

Patentee: Knott

Issue Date: Dec. 31, 1985

U.S. Pat. No. 5,531,253

Patentee: Nishiyama et al.

Issue Date: Jul. 2, 1996

U.S. Pat. No. 5,839,485

Patentee: Wegman et al

Issue Date: Nov. 24, 1998

U.S. Pat. No. 5,685,348

Patentee: Wegman et al

Issue Date: Nov. 11, 1997

U.S. patent application Ser. No. 08/829,925

Applicant: Wegman et al

Filing Date: Apr. 1, 1997

U.S. patent application Ser. No. 08/823,034

Applicant: Wegman et al

Filing Date: Apr. 1, 1997

The relevant portions of the foregoing disclosures may be briefly summarized as follows:

U.S. Pat. No. 5,337,794 describes a powder filling apparatus and a method for filling a container with powder. The toner container is filled by conveying toner from a supply hopper through a nozzle with a valve on the end. The valve is disposed at the bottom opening of the nozzle to release and close the opening of the nozzle by the vertical movement of the valve element.

U.S. Pat. No. 5,438,396 is drawn to a toner anti-dribble device which is attached to a toner container having a vertical fill tube and a rotatable auger for feeding toner into a toner container. The toner anti-dribble device also has a sleeve member engageable with the fill tube. A plurality of flexible insertion wires are inserted through the sleeve member into the toner container and disposed substantially perpendicular to the insertion direction of the toner. The arrangement of the wires positively prevents toner dribble between fills while being flexible enough to flex in proportion to the fill rate, which prevents fusing of the toner on the wires.

U.S. Pat. No. 5,095,338 teaches a developer which discharges used carrier particles using a magnetic valve. Discharge of developer material from the developer housing is controlled by a permanent magnet and an electromagnet positioned adjacent an exit port in the developer housing. The permanent magnet generates a magnetic flux field in the region of the exit port to form a developer material curtain which prevents the passage of developer material from the exit port. When the electromagnet is energized, it generates a magnetic flux field which attracts developer material from the developer material curtain. Upon de-energization of the electromagnet, the developer material attracted to it is discharged.

U.S. Pat. No. 4,977,428 discloses an electrographic printer having a pulse motor for driving a conveyor. The conveyor is built into the developer unit. The conveyor is controlled during the initialization process of the apparatus by setting the rotational speed of the motor at a lower level upon startup of the motor. The lower speed results in higher torque to overcome solidification of the toner.

U.S. Pat. No. 4,932,355 discloses a method for removing a developer mix from a developing station with a magnetic closing device which is in the vicinity of a discharge opening in the developing station. In its energized condition, the magnetic closing device creates a magnetic field which acts on the developer mix to form a plug of developer mix in the region of the discharge opening. In the de-energized condition, the magnetic closing device releases the plug of developer mix.

U.S. Pat. No. 4,650,312 discloses a structure for minimizing bridging or packing of toner in the flights of an auger of a toner removal and collection system. The toner anti-bridging structure includes a pendulum which is caused to periodically bang in to the auger to create vibrations in the auger structure.

U.S. Pat. No. 4,561,759 discloses a device for filling and filtering toner from a supply container. A filter basket is disposed in the region of the filling opening which is closed from the feed container by a filter mesh and an electric vibrator connected thereto by a linkage which can be automatically triggered at the beginning of a filling operation.

U.S. Pat. No. 5,531,253 discloses a cleaner for cleaning the nozzle portion of a powder filling apparatus by equally evacuating the inside and the outside of the container and dropping powder through the nozzle portion into the container simultaneously with the raising the pressure outside the container.

U.S. Pat. No. 5,839,435 filed Oct. 12, 1995, entitled "Electromagnetic Valve and Demagnetizing Circuit", by Wegman et al., which is assigned to the same assignee as this application, teaches a method and apparatus for filling a container with a magnetic material using an electromagnetic valve and a demagnetizing circuit to control the flow and properties of the material. In the filling process an auger located inside of the fill tube rotates and moves the material through the fill tube. When the container is filled, the auger stops rotating and the electromagnetic valve is actuated. The electromagnetic valve supplies a magnetic field which holds the material in place, plugging the fill tube with the material as the container is removed and a new container is placed to be filled. When the electromagnetic valve is switched off, a demagnetizing circuit is activated. After the material is demagnetized the auger is switched on and the material flows again to fill the container.

U.S. Pat. No. 5,685,348, which is assigned to the same assignee as this application, teaches a method and apparatus for filling a container with toner using a series of traveling magnetic fields to control the flow of toner from a supply of toner to the container. Initially, an empty container is placed under a fill tube through which the toner will be supplied to the container. In the filling process the traveling magnetic fields, which are supplied by turning on and off a series of solenoids, and gravity cause toner from the toner supply to move through the fill tube. When a solenoid is turned on toner particles are attracted to its magnetic field where a plug of toner is formed. The solenoids are controlled so that a discrete amount of toner is supplied in each on/off cycle of the solenoids. The solenoid on/off cycle is repeated until the container is filled with toner. When the container is filled, the appropriate solenoid is activated so that a plug of toner stops the flow of toner in the fill tube. The filled container is removed from the fill tube and an empty container is put in its place so that the solenoid on/off cycle may begin again.

U.S. patent application Ser. No. 08/829,925 filed Apr. 1, 1997, entitled "Oscillating Valve for Powders", Wegman et al., which is assigned to the same assignee as this application, teaches a method for filling a powder container. The method includes the steps of placing a first powder container to be filled in filling relationship to a discharge feature in the vessel, directing the powder in the vessel toward a member located at least partially within the vessel, the member defining a restriction therein such that the powder clogs within the restriction, mechanically exciting the powder at least adjacent the restriction to improve the flow properties of the powder so as to unclog the powder within the restriction, dispensing powder through the restriction, through the discharge feature and into the first container, stopping the mechanical excitation of the powder so as to clog the restriction with the powder, removing the first container from the vessel, and placing a second container to be filled in filling relationship to the vessel.

U.S. patent application Ser. No. 08/823,034 filed Apr. 1, 1997, entitled "Vibratory Filler for Powders", Wegman et al., which is assigned to the same assignee as this application, teaches a method for filling a powder container. The method includes the steps of placing a first powder container to be filled in filling relationship to a supply of powder in a vessel, mechanically exciting the powder in the vessel to improve its flow properties, dispensing powder from the vessel into the first container, removing the first container from the vessel, and placing a second container to be filled in filling relationship to the vessel.

All of the above references are hereby incorporated by reference.

SUMMARY OF THE INVENTION

In accordance with one aspect of the present invention, there is provided an apparatus for assisting in filling a container from a hopper containing a supply of powder. The apparatus includes a conduit operably connected to the hopper and extending downwardly therefrom. The conduit is adapted to permit a flow of powder therewithin. The apparatus also includes a nozzle operably connected to the conduit and extending downwardly therefrom. The nozzle defines an inlet thereof for receiving powder from the conduit and defines an outlet thereof for dispensing powder from the nozzle to the container. The inlet defines an inlet cross sectional area perpendicular to the flow the powder and the outlet defines an outlet cross sectional area perpendicular to the flow the powder. The inlet cross sectional area is larger than the outlet cross sectional area. The apparatus further includes a conveyor located at least partially within the conduit. The conveyor assists in providing the flow of powder from the conduit. The dimensions of the nozzle are selected so as to provide a ratio of the inlet cross sectional area to the outlet cross sectional area such that the flow of powder does not seize as it progresses through the nozzle.

Pursuant to another aspect of the present invention, there is provided a method for filling a powder container. The method includes the steps of placing a first powder container to be filled in filling relationship to a conduit extending downwardly from the hopper, directing the powder in the hopper toward a nozzle located at least partially within the hopper, the nozzle defining a restriction therein, defining an inlet cross sectional area perpendicular to the flow the powder and outlet defining an outlet cross sectional area perpendicular to the flow the powder, selecting the inlet cross sectional area to be larger than the outlet cross sectional area, selecting the dimensions of said nozzle so as to provide a ratio of the inlet cross sectional area to the outlet cross sectional area such that the flow of powder does not seize as it progresses through the nozzle, dispensing powder through the conduit, through the nozzle feature and into the first container, removing the first container from the hopper and placing a second container to be filled in filling relationship to the hopper.

DRAWINGS

Other features of the present invention will become apparent as the following description proceeds and upon reference to the drawings, in which.

Figure 10:
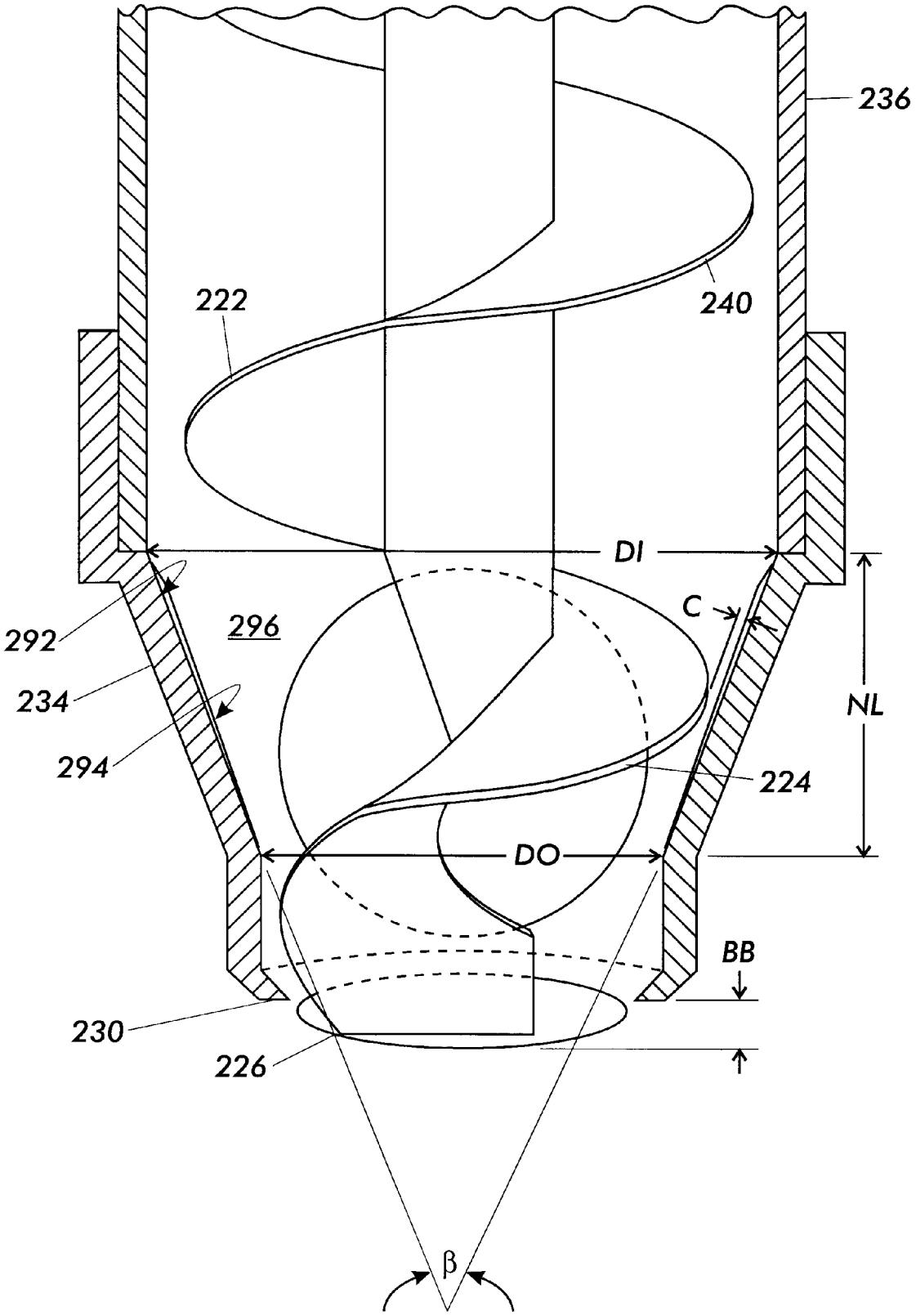
Figure 11:
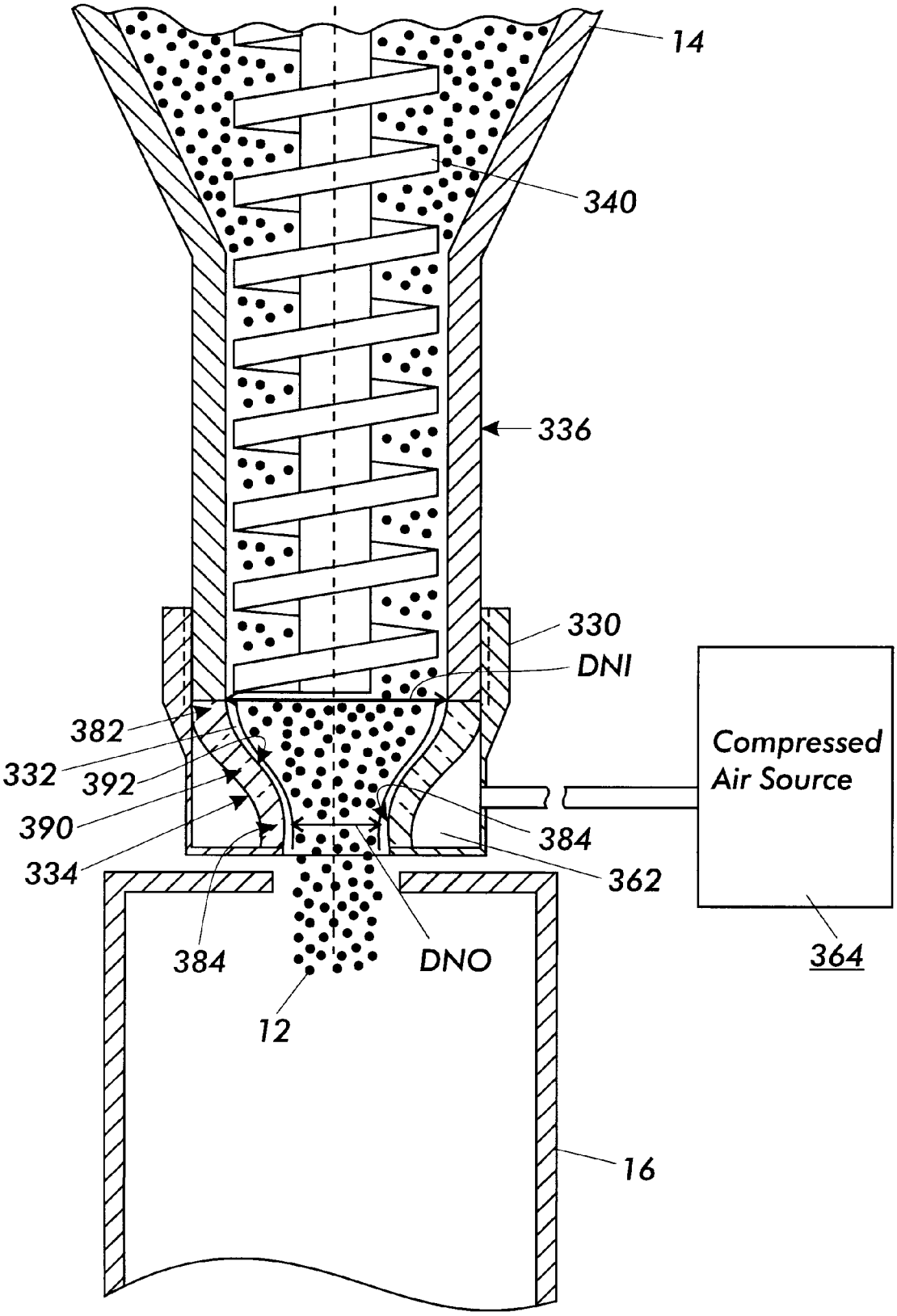

FIG. 10 is a cross-sectional schematic view of an alternate embodiment of the high speed nozzle for developer material of the present invention utilizing a tapered auger with the auger installed in the nozzle; and FIG. 11 is a cross-sectional schematic view of a second alternate embodiment of the high speed nozzle for developer material of the present invention utilizing a nozzle with an air boundary for reduced friction.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
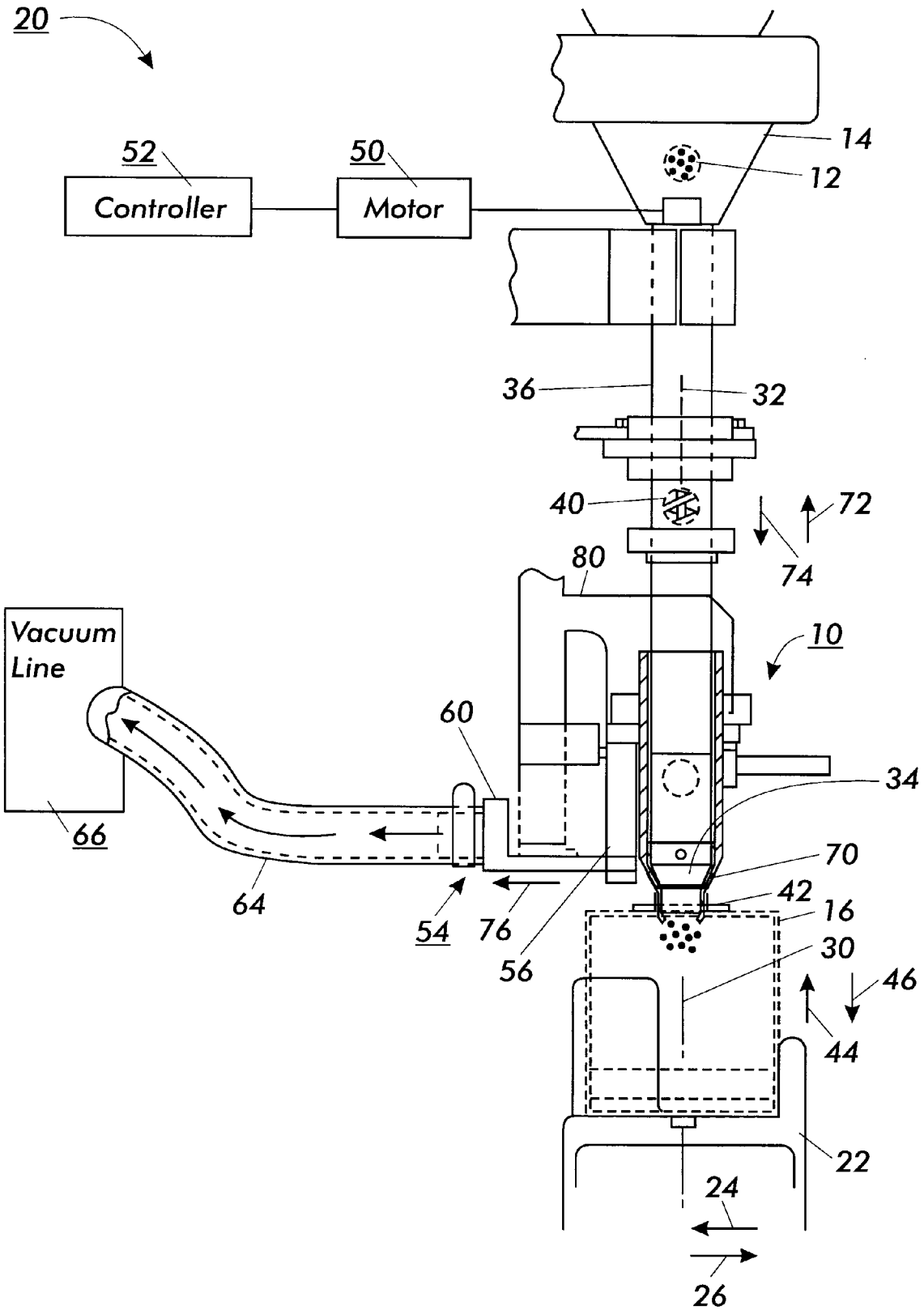
FIG. 2 is an elevational view of a container filling system partially in section utilizing the nozzle of FIG. 1 showing the deflector in use to disperse the developer material with the filling system in the filling position.

According to the present invention and referring now to FIG. 2, powder filling assisting apparatus 10 is shown. The powder filling assisting apparatus 10 is used to convey powder 12 in the form of toner for use in a copier or printer from a hopper 14 to a container 16. The powder filling apparatus 10 is mounted to production filling line 20 preferably to permit for the filling of large production quantities of containers 16, the container 16 is preferably mounted to a carrying device 22. The device 22 is movable in the direction of either arrow 24 or 26. The carrying device 22 serves to position container centerline 30 in alignment with apparatus centerline 32.

The powder filling assisting apparatus 10 includes a nozzle 34 which is used to direct the powder 12 into the container 16. The nozzle 34 is connected to the hopper 14 by means of a conduit 36 preferably in the form of a hollow tube or funnel.

As shown in FIG. 2, the hopper 14 is positioned above the container 16 whereby gravity will assist in the flow of powder 12 toward the container 16. To optimize the flow of powder 12 toward the container 16, the powder filling apparatus 10 further includes a conveyor 40 positioned at least partially within the conduit 36 for assisting in the flow of the powder 12. The conveyor 40 is preferably in the form of a spiral conveyor or auger. For example, the auger 40 may be in the form of a spiral shaped auger.

Preferably, the nozzle 34 is insertable into opening 42 of the container 16. The insertion of the nozzle 34 in the opening 42 may be accomplished in any suitable method. For example, the carrying device 22 and, consequently, the container 16 may be movable upward in the direction of arrow 44 for engagement with the nozzle 34 and downward in the direction of arrow 46 for disengagement from the opening 42. The upward and downward motion of the device 22 and the container 16 permits the container 16 to be indexed in the direction of arrows 24 and 26.

To permit the filling of a number of containers 16, the flow of powder 12 from the hopper 14 must be halted during the indexing of a filled container 16 from the fill position and during the indexing of the unfilled container 16 toward the filling position. As shown in FIG. 2, the flow of powder 12 may be halted by the stopping of auger 40 within the conduit 36. The auger 40 may be rotated by any suitable method, i.e. by motor 50 operably connected to the auger 40. The motor 50 is connected to a controller 52 which sends a signal to the motor 50 to stop the rotation of the auger 40 during indexing of the carrying device 22. It should be appreciated, however, that the flow of powder 12 through the conduit 36 may be further controlled by the use of a valve (not shown).

Preferably, provisions are made to assure that the filling line 20 is free from airborne powder 12 which may escape between the nozzle 34 and the opening 42 of the container 16 during the filling operation and in particular during the indexing of the carrying device for presenting an unfilled container 16 to the powder filling apparatus 10. A clean filling system 54 is shown in FIG. 2 for use with the apparatus 10. The clean filling system 54 preferably includes housing 56. The housing 56 is secured to filling line 20 as well as to the conduit 36.

The housing 56 may serve several purposes. For example, the housing 56 may be used to support slide 60. Slide 60 is connected to a tray 61 which slidably is fitted between the nozzle 34 and the opening 42. The tray 61 may have any suitable form and , as shown in FIG. 2 may be in the form of a toner drip plate. The tray 61 has a first position in which the tray 61 prevents the powder 12 from exiting the nozzle 34. In this extended position, the tray 61 prevents the spilling of powder 12 during the indexing of the containers 16. The tray 61 also has a second retracted position for permitting the powder 12 to flow into the container 16 during filling. The housing 56 preferably also provides a second purpose, namely, to support the conduit 36 and the nozzle 34.

Also, the housing 56 surrounds the nozzle 34 and provides a cavity or chamber 62 which is sealed when the tray 61 is in its closed position. The chamber 62 preferably is kept at a vacuum. The chamber may be maintained at a vacuum in any suitable fashion, e.g. the chamber 62 may be connected by toner dust vacuum line 64 to vacuum source 66. The vacuum source 66 may be in the form of a toner recovery booth.

The housing 56 also may preferably provide an additional function. The housing 56 serves as a registration guide for guiding the nozzle 34 into the opening 42. As shown in FIG. 2, the housing 56 includes a chamfered end 70 which as the container 16 moves in the direction of arrow 44, contacts the opening 42 to register and align the powder filling assisting apparatus 10 with the container 16. Preferably, the housing 56 is slidably mounted to the conduit 36 such that the housing 56 may move upwardly in the direction of arrow 72 and downwardly in the direction of arrow 74. It should be appreciated that the sliding motion of the housing 56 may be accomplished by gravity or by springs as well as by a motor or other mechanism. For example, the housing 56 may be moved upwardly in the direction of arrow 72 by the container 16 moving upwardly in the direction of arrow 44. The nozzle 34, thereby, enters into the opening 42 permitting filling.

Concurrently with the raising of the container 16 to engage with the nozzle 34, the tray 61 is moved to the left in the direction of arrow 76 to permit the powder 12 to flow through the nozzle 34 and into the container 16. It should be appreciated that the tray 61 may be actuated in any manner, for example, by means of a motor or other mechanism, but, as shown in FIG. 2, the tray 61 is preferably operated by a cam mechanism 80 interconnected to the housing 56 such that when the housing 56 moves in the direction of arrow 72, the tray 61 moves in the direction of arrow 76 opening the chamber 62 to communication with the container 16.

FIG. 2 shows the powder filling assisting apparatus 10 in the container up position to enable filling of the container 16. The nozzle 34 is positioned in the opening 42 of the container and the tray 61 is retracted in the position of arrow 76 to permit the flow of toner 12.

Figure 3:
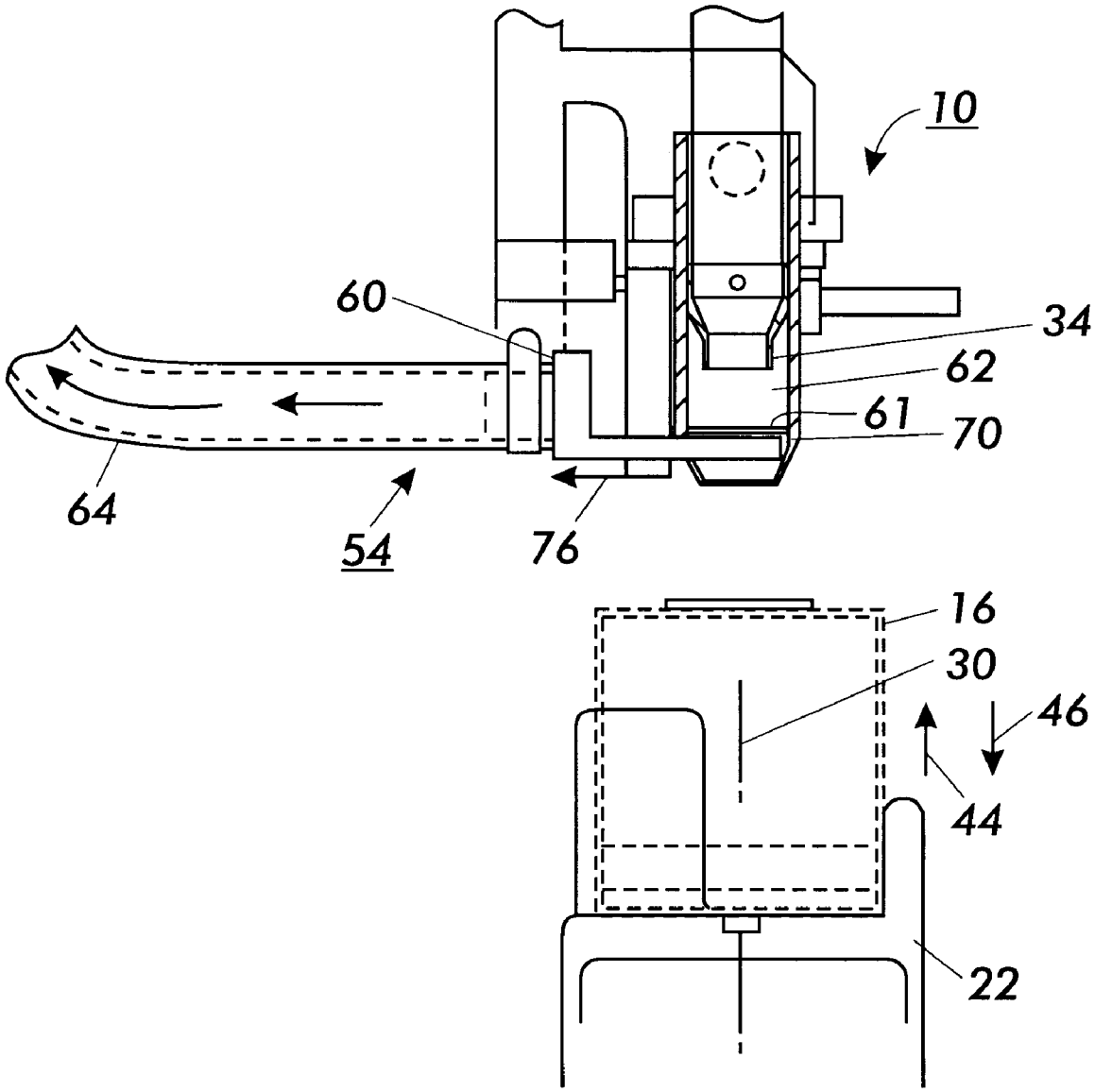
FIG. 3 is a elevational view of a container filling system partially in section utilizing the nozzle of FIG. 1 showing the deflector in use to disperse the developer material with the filling system in the indexing position.

Referring now to FIG. 3, the powder filling assisting apparatus 10 is shown with in the container down position to enable indexing of the carrying device 22. The carrying device 22 indexes the filled container out of the fill position and indexes the unfilled container into the fill position. The nozzle 34 is removed from the opening 42 of the container 16 in this position. The tray 61 is extended into the chamber 62 to catch any dripping toner residue.

Figure 1:
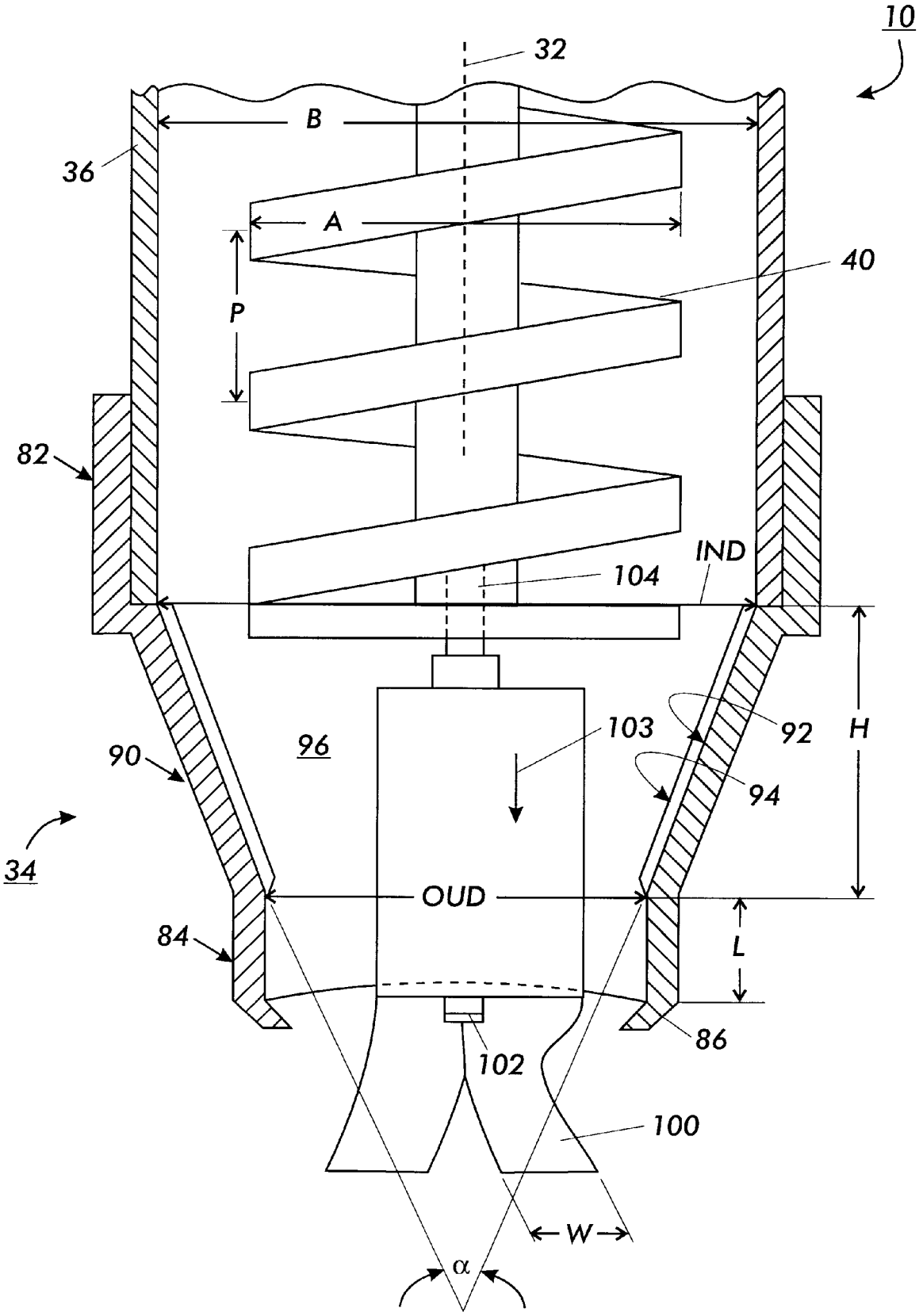
FIG. 1 is a cross-sectional schematic view of a first embodiment of a high speed nozzle for developer material according to the present invention.

Referring now to FIG. 1, the nozzle 34 is shown in greater detail. The nozzle 34 may be made of any suitable durable material, e.g. a plastic or a metal that is chemically non-reactive with the powder 12. For example, the nozzle 34 may be made of stainless steel.

The nozzle may have any suitable shape but includes an inlet 82 adjacent the conduit 36 as well as an outlet 84 opposed to the inlet 82. The nozzle 34 is secured to the conduit 36 in any suitable fashion. For example, as shown in FIG. 1, the nozzle 34 is press fitted over the conduit 36. It should be appreciated that the nozzle may be secured to the conduit by means of fasteners, glue or by welding. Preferably, extending inwardly from the outlet 84 are guide tabs 86 which serve to guide the nozzle 34 into the opening 42 of the container 16. Between the inlet 82 and the outlet 84 of the nozzle 34 is a central portion 90 of the nozzle. The central portion 90 preferably has a hollow substantially conofrustrical shape or funnel like shape.

To assist in the flow of powder 12 within the interior of the nozzle 34, the central portion 90 of the nozzle 34 preferably is coated on inner periphery 92 of the nozzle 34 with a coating 94. The coating 94 is preferably made of a material with a low coefficient of friction. A coefficient of friction of less than 0.25 is preferred. Polytetrafluoroethylene is particularly well suited for this application.

The auger 40 is rotatably secured within the conduit 36. The auger 40 may float within the conduit 36 or be supported to the conduit 36 at its distal ends. The auger 40 may be of any particular configuration but preferably is a spiral auger. The auger 40 rotates at a suitable speed to optimize the flow of powder 12 through the nozzle 34.

For example, for a conduit 36 having a diameter B of 1.25 inches, the auger 40 preferably has an auger diameter A of approximately 1.0 inches. For an auger with an auger diameter A of 1.0 inches, the auger 40 may rotate at a rotational speed of approximately 500 rpm. For the auger with an auger diameter A of 1.0 inches, the auger 40 may have a pitch P or distance between adjacent blades of the auger of approximately 1.0 inches. It should be appreciated that the optimum rotational speed of the auger 40 is dependent on the value of the pitch P.

As shown in FIG. 1, the auger 40 may terminate at the inlet portion 82 of the nozzle. The invention may be practiced with the central portion 90 of the nozzle 34 including an empty cavity or chamber 96.

The nozzle 34 is designed such that the nozzle has an inlet diameter IND at inlet 82 which is larger than outlet diameter OUD such that the flow of powder for a given auger and rotational speed may be maximized. It should be appreciated that different powders have different densities and thus the dimensions of IND and OUD need to be varied for optimum flow of the powder. For example, as shown in FIG. 1, for a toner having a particles size of approximately 7 microns and utilizing an auger 40 with a rotational speed of 500 rpms, the inlet diameter IND is approximately 1.25 inches and the outlet diameter OUD is approximately 0.875 inches. For a nozzle with a distance between the inlet and outlet or height H of the central portion of approximately 0.7 inches, the included angle $\alpha$ of the inner periphery 92 of the nozzle 34 is approximately 20 degrees.

When utilizing the nozzle 34 to fill containers having an opening which is not concentric with the container, the use of a deflector 100 is preferred. Preferably, the deflector 100 is mechanically connected to the auger 40 and rotates therewith. As shown in FIG. 1, the deflector 100 is connected to holder 102. Holder 102 is secured to auger 40 by any suitable means. For example, the holder 102 is secured to auger 40 by means of threads 104.

The deflector 100 may be made of any suitable material. For example, the deflector may be made of plastic or metal. The deflector 100 may be made of stainless steel. As shown in FIG. 2, the deflector 100 is in the form of deflector blades. While the deflector 100 may be made from a single blade, preferably the deflector 100 includes a plurality of equally spaced blades around holder 102. As shown in FIG. 1, the deflector blade has a width W of approximately 0.60 inches for use when the nozzle 34 has an OUD of 0.875 inches.

Preferably, the outlet 84 extends in a direction of arrow 103 along axis 32 a distance L of 0.2 inches to permit the nozzle 34 to engage the opening 42 of container 16 (see FIG. 2).

Figure 4:
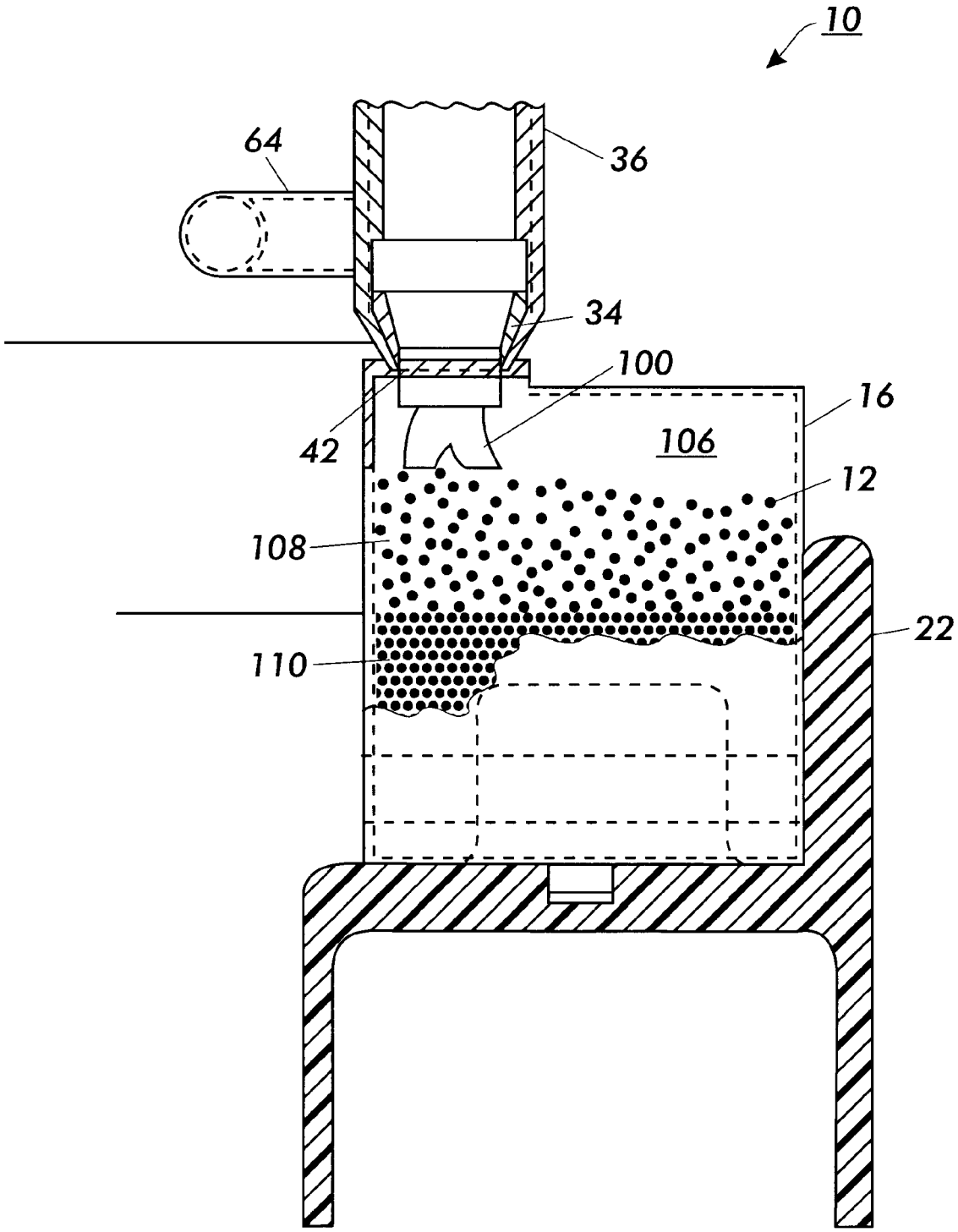
FIG. 4 is a side view of the container filling system of FIG. 2.

Referring now to FIG. 4, the toner filling assisting apparatus 10 is shown engaged with toner container 16. As shown in FIG. 4, the nozzle 34 is immersed into the toner container 16 through opening 42 therein. The deflector 100 is located within chamber 106 of the container 16. The deflector 100 serves to deflect the powder 12 within the container 16 to provide an area of airborne toner 108 in the upper portion of the container. As the airborne toner 108 settles, settled toner 110 forms uniformly within the container 16 assuring a thorough filling of the container 16.

Figure 7:
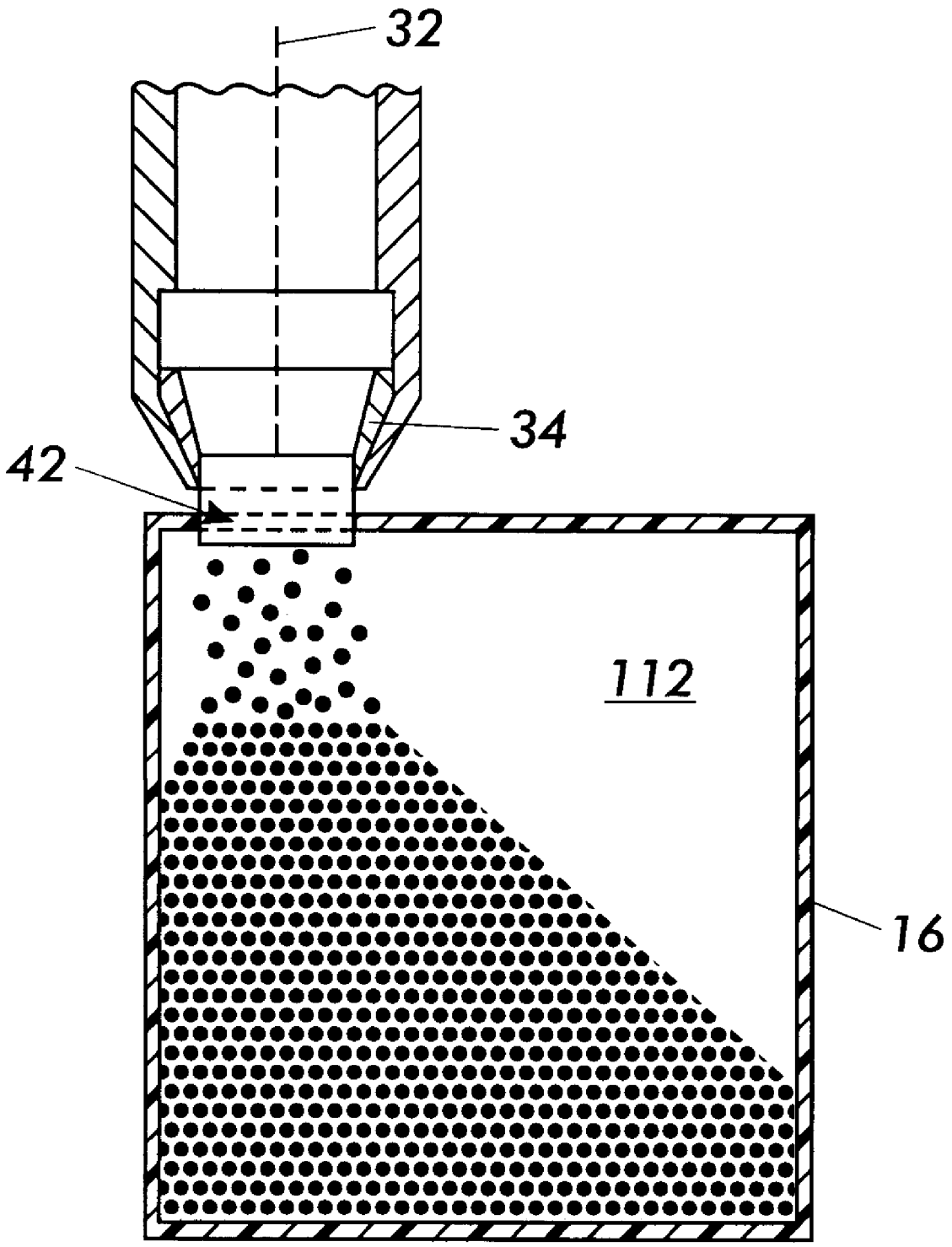
FIG. 7 is an elevational view of a container for use with the high speed nozzle of FIG. 1 without the deflector showing the filling of the container.
Figure 8:
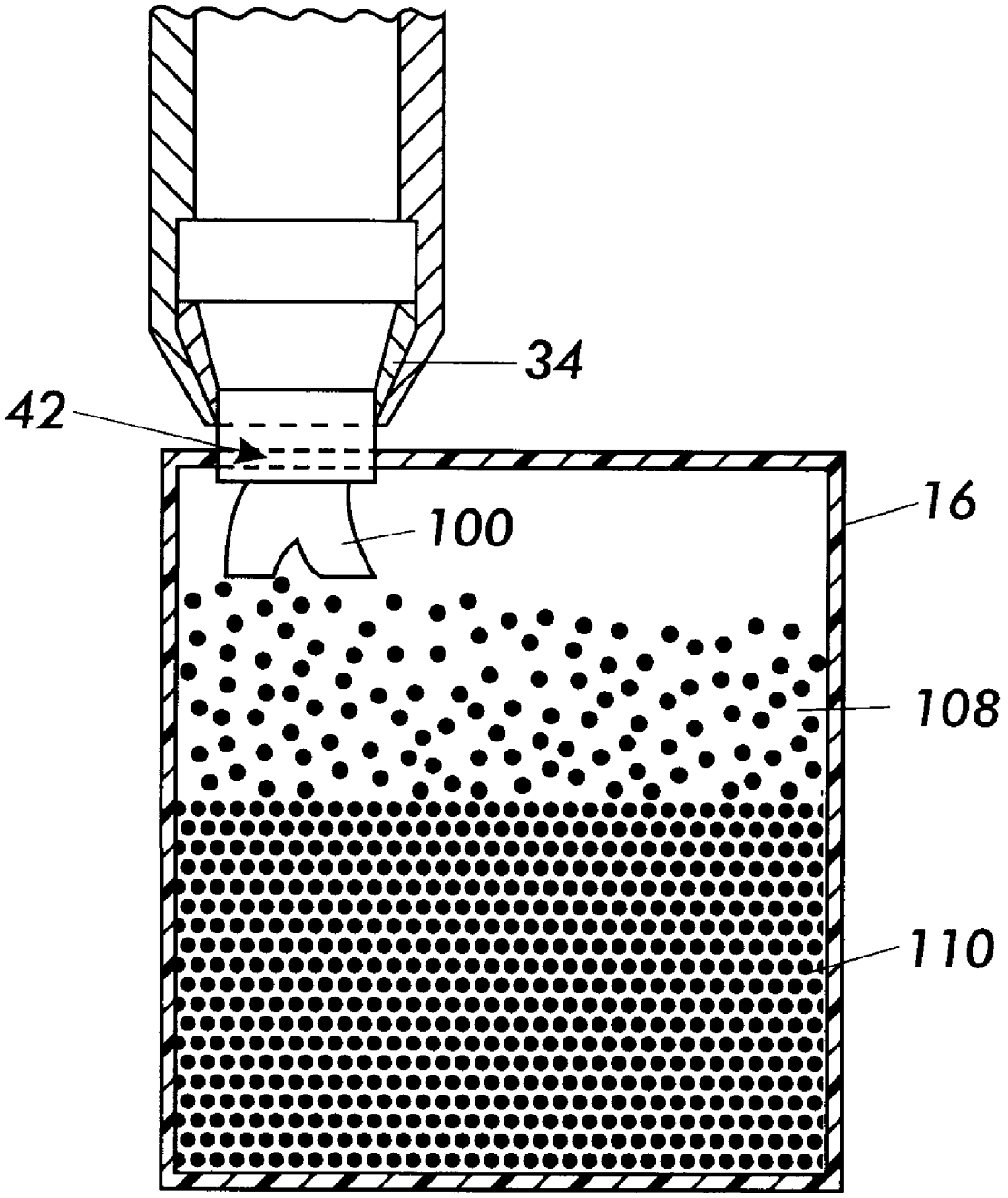
FIG. 8 is an elevational view of a container for use with the high speed nozzle of FIG. 1 showing the deflector in use to disperse the developer material.

Referring now to FIGS. 7 and 8, the advantage of utilizing the deflector 100 is shown. In FIG. 7, the nozzle 34 is shown without the deflector 100 in place. The nozzle 34 directs the powder 12 into a pile centered along nozzle centerline 32. As can be appreciated from FIG. 7, an air gap 112 is formed within the cartridge 16 creating a partially filled toner container 16.

Referring now to FIG. 8, the nozzle 34 is shown with the deflector 100 secured therein. The deflector 100 serves to scatter the toner into airborne toner 108 which settles into settled toner 110 which is evenly dispersed within the toner container 16.

Figure 5:
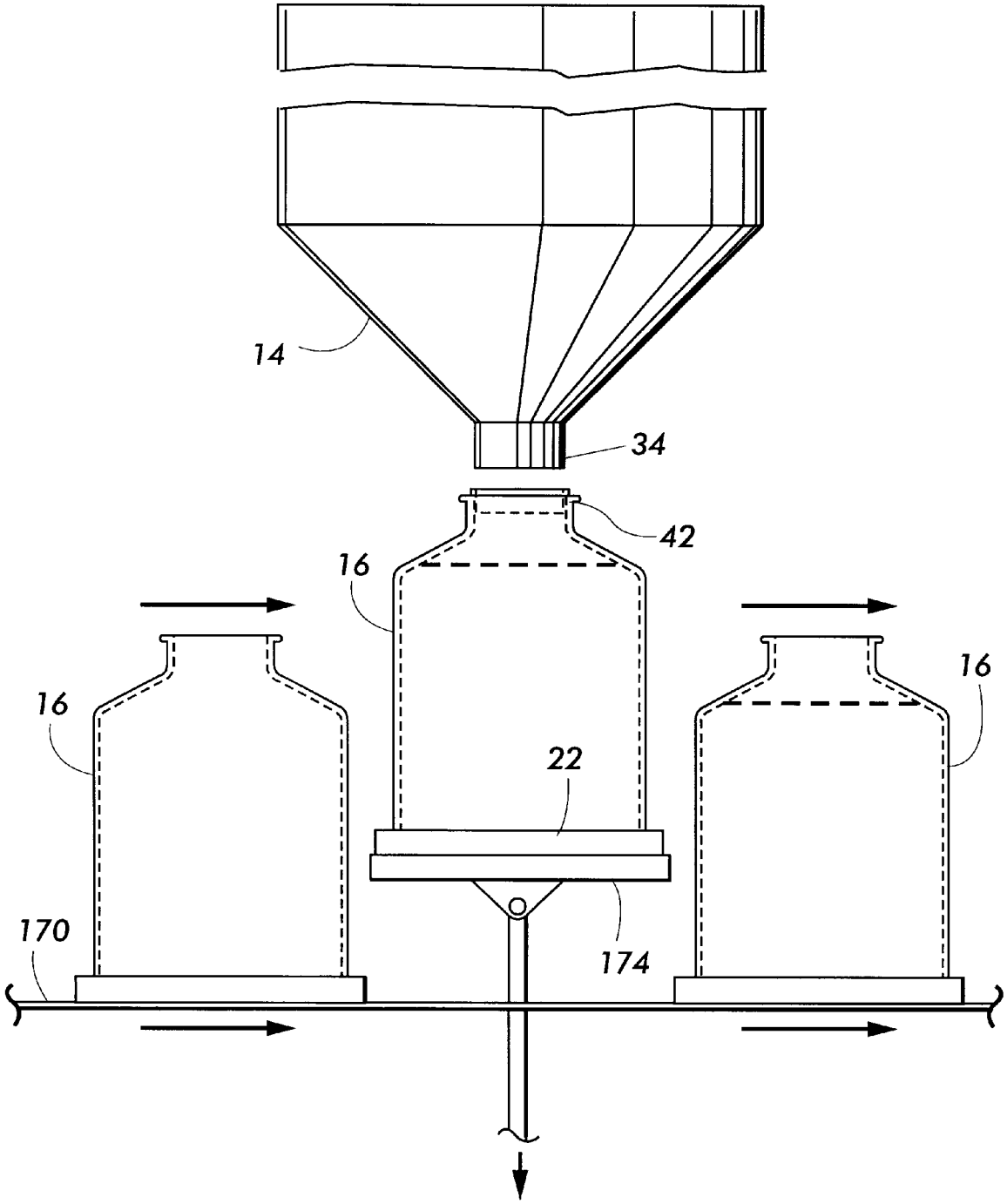
FIG. 5 is an elevational view of a container filling system partially in section for use with the high speed nozzle for developer material of FIG. 1 after the container is filled.

Now referring to FIG. 5, a side view of moving containers 16 along an indexing conveyor 170 relative to the nozzle 34 is depicted, which is relevant to all of the embodiments. Each of the containers is positioned in a carrying device 22, also known as a puck. Each puck is specially designed and built for each type of toner container, the puck allowing for different container widths and heights. A puck is used so that the same conveying and lifting system can be used with varying toner container types. When the container is in position under the fill tube the lifting mechanism 174 pushes the puck with the container in it up until the lifting mechanism is fully extended. When the lifting mechanism is fully extended, the container is in the proper filling relationship with the fill tube. It should be appreciated that the container may be placed on a conveyor without a puck, particularly if the filling line is a dedicated line and if the container has a self-supporting shape that would not to permit the container to easily tip.

Figure 6:
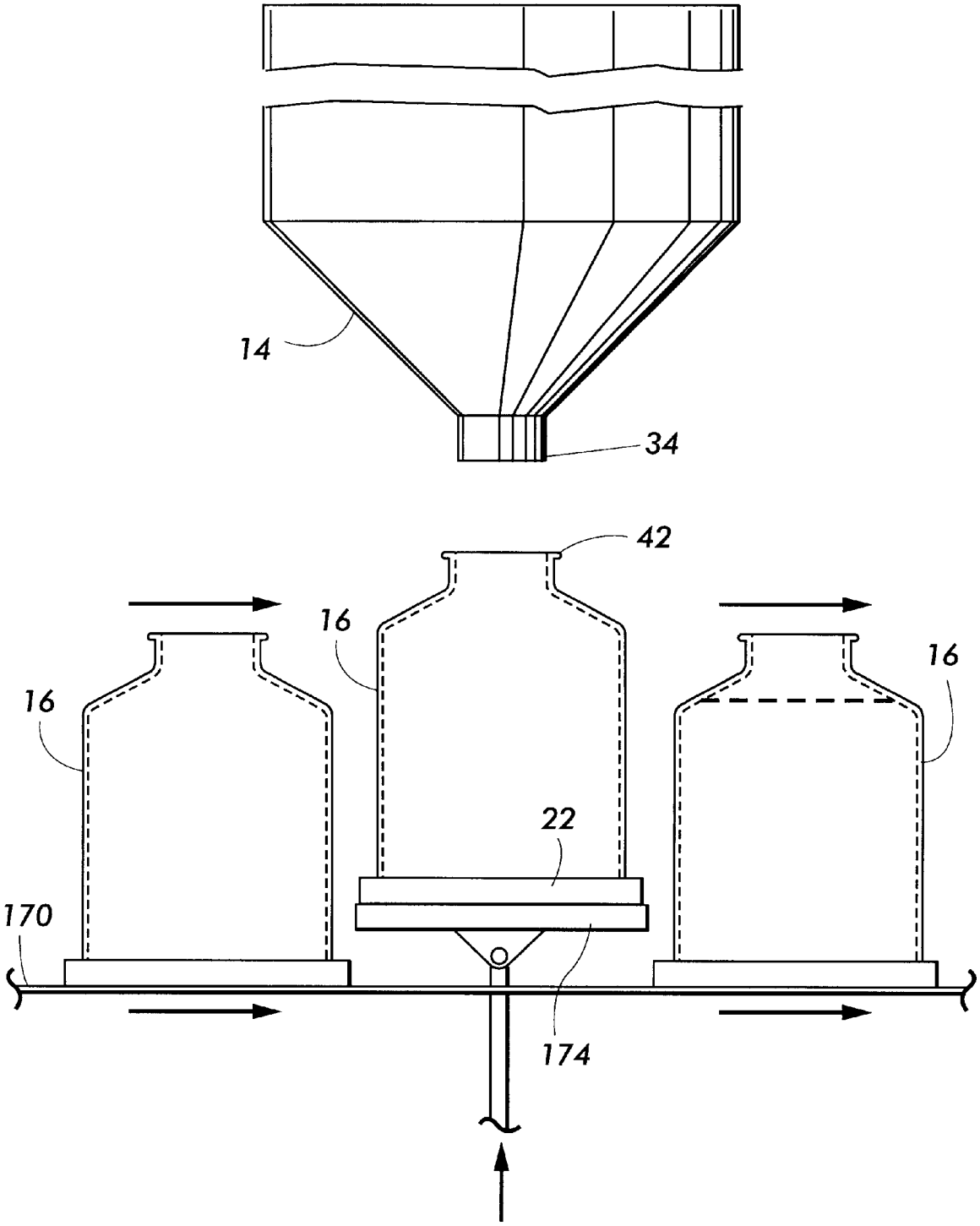
FIG. 6 is an elevational view of the container filling system for use with the high speed nozzle for developer material of FIG. 1 prior to filling the container.

FIG. 6 shows the container in the proper filling relationship to the fill tube, the container opening 42 receiving the end of the nozzle 34. The amount of toner loaded in the container is predetermined based on the size of the container and the toner flow is controlled by a particular number of cycles of the high speed filler. Once the predetermined amount of toner passes through the fill tube for a particular number of cycles of the high speed filler the container is filled and the filling process is stopped so that the container may be moved from under the fill tube.

Figure 9:
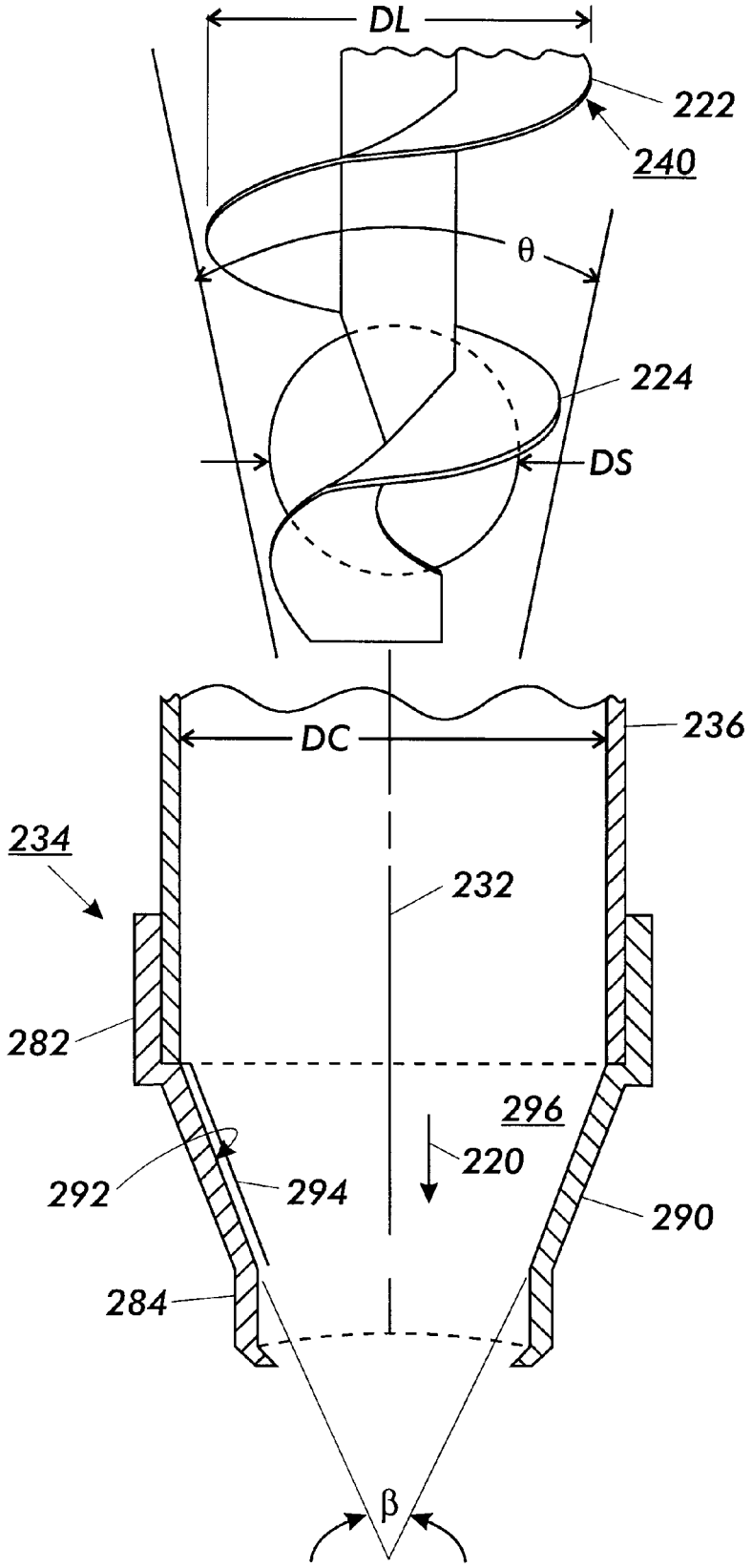
FIG. 9 is a cross-sectional schematic view of an alternate embodiment of the high speed nozzle for developer material of the present invention utilizing a tapered auger with the auger removed from the nozzle.

Referring now to FIG. 9, a first alternate embodiment of the nozzle of the present invention is shown in nozzle 234. Nozzle 234 is similar to nozzle 34 of FIGS. 1–7. Nozzle 234 is secured to conduit 236. Conduit 236 is similar to conduit 36 of FIGS. 1–7. Auger 240 is rotatably fitted within conduit 236 and serves to advance the powder 12 in the direction of arrow 220 along axis 232. Auger 240 includes a cylindrical portion 222 which is matedly fitted to conduit 236. Cylindrical portion 222 has a diameter DL which is slightly smaller than diameter DC of the conduit. Extending downward from the cylindrical portion 220 of the auger 240 is a tapered portion 224 of the auger 240. The tapered portion 224 is fitted at least partially within cavity 296 formed within inner periphery 292 of the central portion 290 of the nozzle 234. The nozzle 234 is secured to the conduit 236 at inlet 282. Extending downwardly from the central portion 290 of the nozzle 234 is outlet 284. Inlet 282 and outlet 284 are similar to inlet and outlets 82 and 84 of the nozzle 34 of FIGS. 1–7.

Referring now to FIG. 10, the auger 240 is shown in position within the nozzle 234. The cylindrical portion 222 of the auger 240 is fitted within the conduit 236 while the tapered portion 224 of the auger 240 is fitted partially within cavity 296. The nozzle 234 similar to the nozzle 34 of FIGS. 1–7, has an inlet diameter DI and an outlet diameter DO. For an auger 240 with a diameter of approximately 1.25 inches preferably the inlet diameter DI is approximately 1.25 inches and the outlet diameter DO is approximately 0.875 inches. The inlet and outlet diameter are spaced apart in the direction of centerline 232 a distance NL of approximately 0.7 inches. Inner periphery 292 of the central portion 290 thus forms an included angle $\beta$ of approximately 20 degrees. Preferably, the tapered portion 224 of the auger 240 has an included angle $\theta$ equal to angle $\beta$ of the inner periphery 292 of the central portion 290 of the nozzle 234. Preferably, the inner periphery 292 of the nozzle 234 includes a coating 294 thereon which is similar to coating 94 of the nozzle 34. The tapered portion 224 of the auger 240 is preferably spaced from the coating 294 a distance C sufficient to provide for operating clearance therebetween. A dimension C of approximately 0.05 inches is sufficient.

Optionally, the auger 240 may include a protruding portion 226 which extends downwardly from the tapered portion 224 of the auger 240. The protruding portion 240 extends a distance BB below lower surface 230 of the nozzle 234. A distance BB of approximately 0.2 inches has been found to be sufficient. The protruding portion 226 serves to prevent clogging of the powder within the nozzle 234 as well as to provide a method of deflecting the toner particles to evenly fill the container.

Referring now to FIG. 11, a second alternative embodiment of the nozzle according to the present invention is shown as nozzle 334. Nozzle 334 is secured to conduit 336 and extends downwardly therefrom. Conduit 336 is similar to conduit 36 of FIGS. 1–7. Auger 340 is preferably rotatably fitted within conduit 336. Auger 340 is similar to auger 40 of FIGS. 1–7. As shown in FIG. 11, the nozzle 334 extends downwardly from the conduit 336. The nozzle 334 includes a tapered portion 390 which has a generally conofrustrical hollow shape. The tapered portion 390 as shown in FIG. 11 has a concave or bowl type shape. It should be appreciated that the tapered portion 390 may likewise have convex or a neutral shape. The tapered portion 390 has a diameter DNI at nozzle inlet 382 and a diameter DNO at the nozzle outlet 384 which is smaller than the nozzle inlet diameter DNI. The nozzle 334 as shown in FIG. 11 is made of a porous material. The nozzle 334 may be made of any suitable durable material e.g. a porous plastic material. Such a porous plastic material is available from Porex Technologies Corporation, Fairburn, Ga., USA and is sold as Porex® porous plastics. The use of high density polyethylene with a pore size of approximately 20 microns is suited for this application.

To assist in the flow of the toner 12 and to avoid coating the inner periphery 392 of the nozzle 334 with a coating which may tend to wear quickly, the nozzle 334 includes a boundary layer of flowing air 332 located internally of inner periphery 392 of the nozzle 334. The boundary layer of flowing air 334 may be accomplished in any suitable manner. For example, as shown in FIG. 11, the nozzle 334 is surrounded by a housing 330. The housing 330 is secured to the conduit 336 and to the bottom portion of the nozzle 334. The housing 330 thus forms an external cavity 362 between the housing 330 and nozzle 334. Preferably, the external cavity 362 is connected to a compressed air source 364 whereby compressed air is forced through the porous nozzle 334. The compressed air source 364 thus serves to provide the boundary layer of flowing air 332 between the nozzle 334 and the powder 12. The compressed air source may include a valve (not shown) to regulate the amount of air in order to form a proper boundary layer of flowing air 332 to optimize the flow of toner 12 through the nozzle 334.

By providing a high speed nozzle with a diameter ratio at the inlet and outlet of the nozzle which are chosen to optimize flow within the nozzle, a nozzle may be provided which optimizes flow within the nozzle.

By providing a high speed filling nozzle with an inner periphery with a coating of low friction material, the flow within the nozzle may be maximized.

By providing a boundary layer of air between the inner periphery of a nozzle and the toner flowing therethrough, the flow of toner within the nozzle may be maximized.

By providing a deflector at the outlet of a nozzle, the flow of powder through the nozzle may be evenly dispersed into a container such that the container may be more completely filled and so that voids may not be present within a container.

By providing a high speed nozzle including a tapered auger positioned therein, the flow of toner through the auger may be maximized and, at the same time, control of the amount of powder dispensed, normally referred to as the fill weight, may be maximized.

By providing a high speed nozzle including a porous material, the flow within the nozzle may be maximized by providing a layer of air to reduce the friction between the nozzle and the powder.

In recapitulation, a high speed toner filler for developer material has been described as an improved method for maximizing toner flow for filling toner containers with small apertures. This method allows toner to be moved more accurately and rapidly than prior art systems and also insures that the toner container is filled quickly, completely and cleanly.

It is, therefore, apparent that there has been provided in accordance with the present invention, a high speed toner filler that fully satisfies the aims and advantages hereinbefore set forth. While this invention has been described in conjunction with specific embodiments, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for assisting in filling a container from a hopper containing a supply of powder, the apparatus comprising:

a conduit operably connected to the hopper and extending downwardly therefrom, said conduit adapted to permit a flow of powder therewithin;

a nozzle operably connected to the conduit and extending downwardly therefrom, said nozzle defining an inlet thereof for receiving powder from the conduit and defining an outlet thereof for dispensing powder from the nozzle to the container, the inlet defining an inlet cross sectional area perpendicular to the flow the powder and outlet defining an outlet cross sectional area perpendicular to the flow the powder, the inlet cross sectional area being larger than the outlet cross sectional area; and an auger located at least partially within said conduit and at least partially within said nozzle, said auger closely conforming to said conduit and to said nozzle, the auger assisting to provide the flow of powder through the conduit, wherein the dimensions of said nozzle are selected so as to provide a ratio of the inlet cross sectional area to the outlet cross sectional area such that the flow of powder does not seize as it progresses through the nozzle, said nozzle defining an inner surface thereof, at least a portion of said inner surface being coated with a material having a surface with a coefficient of friction of less than 0.25.

2. An apparatus for assisting in filling a container from a hopper containing a supply of powder, as claimed in claim 1, wherein said material comprises polytetrafluoroethylene.

3. An apparatus for assisting in filling a container from a hopper containing a supply of powder, the apparatus comprising:

a conduit operably connected to the hopper and extending downwardly therefrom, said conduit adapted to permit a flow of powder therewithin;

a nozzle operably connected to the conduit and extending downwardly therefrom, said nozzle defining an inlet thereof for receiving powder from the conduit and defining an outlet thereof for dispensing powder from the nozzle to the container, the inlet defining an inlet cross sectional area perpendicular to the flow the powder and outlet defining an outlet cross sectional area perpendicular to the flow the powder, the inlet cross sectional area being larger than the outlet cross sectional area;

an auger located at least partially within said conduit and at least partially within said nozzle, said auger closely conforming to said conduit and to said nozzle, the auger assisting to provide the flow of powder through the conduit, wherein the dimensions of said nozzle are selected so as to provide a ratio of the inlet cross sectional area to the outlet cross sectional area such that the flow of powder does not seize as it progresses through the nozzle; and a deflector operably associated with said nozzle for deflecting the powder as it exits said nozzle.

4. An apparatus for assisting in filling a container from a hopper containing a supply of powder, as claimed in claim 3, wherein said deflector comprises a blade attached to said auger.

5. An apparatus for assisting in filling a container from a hopper containing a supply of powder, the apparatus comprising:

a conduit operably connected to the hopper and extending downwardly therefrom, said conduit adapted to permit a flow of powder therewithin;

a nozzle operably connected to the conduit and extending downwardly therefrom, said nozzle defining an inlet thereof for receiving powder from the conduit and defining an outlet thereof for dispensing powder from the nozzle to the container, the inlet defining an inlet cross sectional area perpendicular to the flow the powder and outlet defining an outlet cross sectional area perpendicular to the flow the powder, the inlet cross sectional area being larder than the outlet cross sectional area;

an auger located at least partially within said conduit and at least partially within said nozzle, said auger closely conforming to said conduit and to said nozzle, the auger assisting to provide the flow of powder through the conduit, wherein the dimensions of said nozzle are selected so as to provide a ratio of the inlet cross sectional area to the outlet cross sectional area such that the flow of powder does not seize as it progresses through the nozzle; and a tray positionable between said nozzle and the container for collecting powder when the nozzle is spaced from the container.

6. An apparatus for assisting in filling a container from a hopper containing a supply of powder, as claimed in claim 5, further comprising a housing operably associated with said nozzle for aligning said nozzle with the container.

7. An apparatus for assisting in filling a container from a hopper containing a supply of powder, as claimed in claim 6, further comprising a vacuum source operably associated with said housing for removing the powder from said housing.

8. An apparatus for assisting in filling a container from a hopper containing a supply of powder, the apparatus comprising:

a conduit operably connected to the hopper and extending downwardly therefrom, said conduit adapted to permit a flow of powder therewithin;

a nozzle operably connected to the conduit and extending downwardly therefrom, said nozzle defining an inlet thereof for receiving powder from the conduit and defining an outlet thereof for dispensing powder from the nozzle to the container, the inlet defining an inlet cross sectional area perpendicular to the flow the powder and outlet defining an outlet cross sectional area perpendicular to the flow the powder, the inlet cross sectional area being larger than the outlet cross sectional area, at least a portion of said nozzle having a hollow, substantially conofrustrical shape, the hollow conofrustrical portion defining a cavity therein; and an auger located at least partially within said conduit and at least partially within said nozzle, said auger closely conforming to said conduit and to said nozzle, the auger assisting to provide the flow of powder through the conduit, wherein the dimensions of said nozzle are selected so as to provide a ratio of the inlet cross sectional area to the outlet cross sectional area such that the flow of powder does not seize as it progresses through the nozzle, said auger being spaced from the cavity.

9. An apparatus for assisting in filling a container from a hopper containing a supply of powder, the apparatus comprising:

a conduit operably connected to the hopper and extending downwardly therefrom, said conduit adapted to permit a flow of powder therewithin;

a nozzle operably connected to the conduit and extending downwardly therefrom, said nozzle defining an inlet thereof for receiving powder from the conduit and defining an outlet thereof for dispensing powder from the nozzle to the container, the inlet defining an inlet cross sectional area perpendicular to the flow the powder and outlet defining an outlet cross sectional area perpendicular to the flow the powder, the inlet cross sectional area being larger than the outlet cross sectional area;

an auger located at least partially within said conduit and at least partially within said nozzle, said auger closely conforming to said conduit and to said nozzle, the auger assisting to provide the flow of powder through the conduit, wherein the dimensions of said nozzle are selected so as to provide a ratio of the inlet cross sectional area to the outlet cross sectional area such that the flow of powder does not seize as it progresses through the nozzle, said auger being spaced from said conduit approximately 0.05 inches.

10. A method for filling a powder container with a supply of powder in a hopper, comprising:

placing a first powder container to be filled in filling relationship to a conduit extending downwardly from the hopper;

directing the powder in the hopper toward a nozzle in communication with the hopper, the nozzle defining a restriction therein;

defining an inlet cross sectional area perpendicular to the flow the powder and outlet defining an outlet cross sectional area perpendicular to the flow the powder;

selecting the inlet cross sectional area to be larger than the outlet cross sectional area;

selecting the dimensions of said nozzle so as to provide a ratio of the inlet cross sectional area to the outlet cross sectional area of approximately two to one such that the flow of powder does not seize as it progresses through the nozzle;

dispensing powder through the conduit, through the nozzle feature and into the first container;

removing the first container from the hopper;

placing a second container to be filled in filling relationship to the hopper; and providing an auger closely conforming to the conduit and to the nozzle.

* * * * *